US006334033B1

(12) United States Patent
Ayash et al.

(10) Patent No.: US 6,334,033 B1
(45) Date of Patent: Dec. 25, 2001

(54) AMBIENT ATMOSPHERIC PRESSURE COMPENSATION CONTROLLER FOR PRESSURIZED COPYING DEVICE

(75) Inventors: Karl B. Ayash, Webster; Thomas C. Hollar, Penfield; Ali R. Dergham, Rochester; Dennis M. Ankrom, Williamson, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/714,973

(22) Filed: Nov. 20, 2000

Related U.S. Application Data

(60) Provisional application No. 60/200,808, filed on May 1, 2000.

(51) Int. Cl.[7] ..... G03G 21/00; G03G 15/00

(52) U.S. Cl. ..... 399/91; 399/98; 399/110

(58) Field of Search ..... 399/91, 92, 98, 399/107, 110, 116

(56) References Cited

U.S. PATENT DOCUMENTS

| | | | | |
|---|---|---|---|---|
| 5,467,180 | * | 11/1995 | Malachowski et al. | 399/381 |
| 5,689,766 | * | 11/1997 | Hollar et al. | 399/92 |
| 5,946,528 | * | 8/1999 | Cho | 399/98 X |
| 6,003,608 | * | 12/1999 | Cunningham | 169/46 |
| 6,266,494 | * | 7/2001 | Budnik et al. | 399/55 |

* cited by examiner

*Primary Examiner*—Sophia S. Chen
(74) *Attorney, Agent, or Firm*—Oliff & Berridge, PLC

(57) ABSTRACT

A method and apparatus for maintaining the air pressure within a xerographic module/chamber of an image forming device above ambient pressure outside of the xerographic module/chamber which uses a pressure sensor, e.g., an altimeter to monitor ambient atmospheric pressure, and a microprocessor to control and maintain air pressure to a determined set point.

6 Claims, 4 Drawing Sheets

FIG. 1a
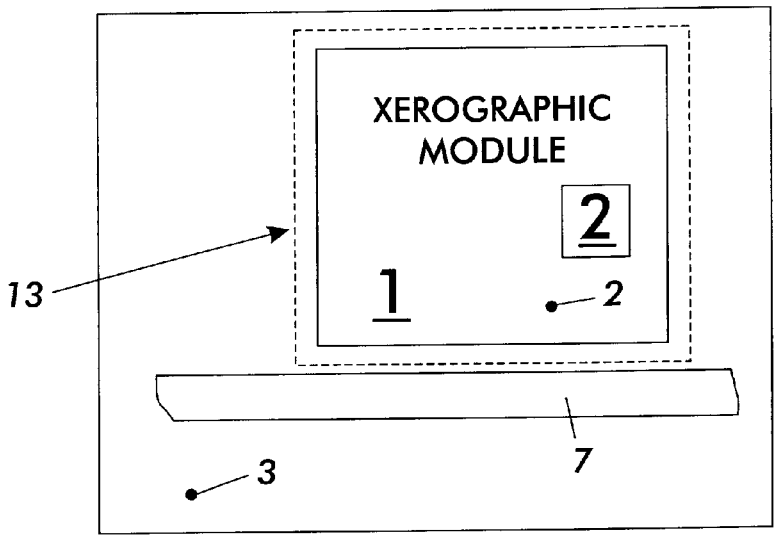
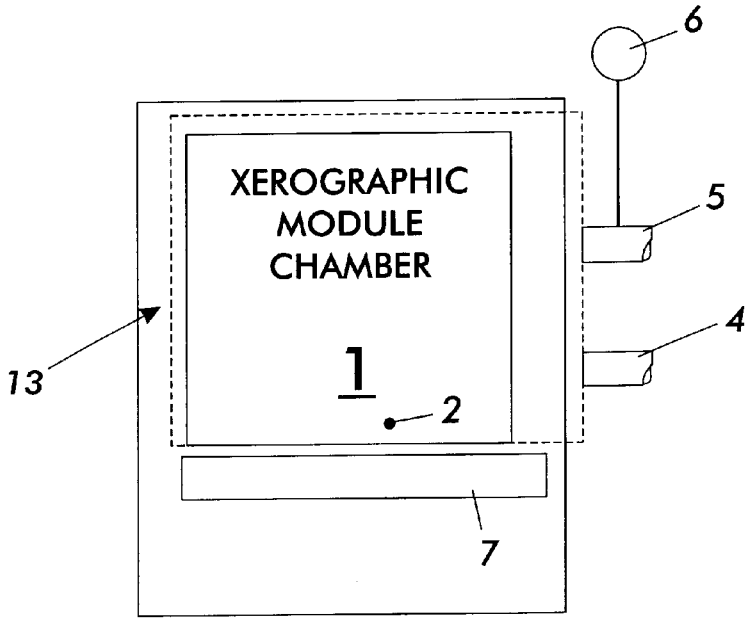
FIG. 1b

AMBIENT ATMOSPHERIC PRESSURE COMPENSATION CONTROLLER FOR PRESSURIZED COPYING DEVICE

This application claims the benefit of U.S. Provisional Application No. 60/200,808, filed on May 1, 2000.

BACKGROUND OF THE INVENTION

1. Field of Invention

This invention concerns maintaining the air pressure in a xerographic module of an image forming device.

2. Description of Related Art

This invention is related to co-pending application, Ser. No. 09/714,994, entitled, "Method and Apparatus for Controlling Humidity in a Copying Device," filed on May 1, 2000, incorporated herein by reference in its entirety.

Many different types of image forming devices are available in the marketplace. Some of these devices employ a xerographic process for producing the images. In a typical xerographic image forming device, all elements are located in the same ambient atmosphere, and the air pressure throughout the entire image forming device is the same as the ambient atmospheric pressure. Because some of these devices employ fans and blower motors to direct air throughout parts of the image forming device, the air pressure throughout the machine may differ depending on whether a blower is operated or not. Typically, there is no specific compartment or module in the image forming device that is separated from the rest of the image forming device and maintained at a different pressure than the other parts of the image forming device.

SUMMARY OF THE INVENTION

As a result, contaminants from supplies used in the image forming device, such as paper and toner, are routinely circulated throughout parts of the image forming device. Also, contaminated room air is sucked into image forming device, including the xerographic module that might contain chemicals, dust and other contaminants. Filters and traps may be employed to reduce contaminants, such as, for example, toner, which has been picked up by air flowing through the image forming device, from adversely affecting components in other parts of the image forming device. Another source of contaminants are the image recording media used in the image forming device on which the image is formed and fixed. Contaminants from the image forming media include water vapor and image forming media fibers as well as toner applied to the image recording media throughout the xerographic process. However, even filters and traps will not eliminate contamination of xerographic system elements such as the imaging optics, the media transport elements, machine frames, toner bottles, and other elements.

The invention provides systems and methods for maintaining the pressure within a xerographic module of an image forming device within a specific range.

This invention further provides systems and methods that maintain the pressure in the xerographic module higher than the air pressure of the ambient atmosphere where the image forming device is located as well as outside of the xerographic module.

Maintaining a higher pressure in the xerographic module reduces the chance of contaminants from the image recording media entering and adversely affecting elements within the xerographic module. A positive pressure differential is maintained between the air pressure in the xerographic module and the air pressure both of the image forming device outside of the xerographic module and of the atmosphere in which the device is located.

In accordance with the systems and methods of this invention, an image forming device includes a xerographic module which includes various elements used to produce an image. Typically these elements include a light exposure device, a photoreceptor usable to generate a latent image, a developer unit that transfers toner to develop the latent image, a transfer unit that transfers the developed image to the image recording media, and a fuser. The xerographic module is located within a chamber in which the air pressure is maintained slightly above ambient pressure both within the other portions of the image forming machine and the surrounding atmosphere. This higher pressure within the xerographic module helps to prevent contaminants in unfiltered air from outside the xerographic module from entering into the xerographic module and contaminating the elements of the xerographic module or in some way adversely affecting the performance and condition of the xerographic module.

In a first exemplary embodiment of the systems and methods of this invention the xerographic module includes a pressurized semi-air-tight enclosure with a small gap between the xerographic module and the media path. This small gap prevents rapid loss of pressure from the xerographic module. A pressure sensor, such as, for example, an altimeter, is used to measure the ambient atmospheric pressure. A microcontroller is used to maintain the air pressure inside the xerographic module above the measured ambient atmospheric pressure.

These and other features and advantages of this invention are described in or are apparent from the following detailed description of various exemplary embodiments of the systems and methods according to this invention.

BRIEF DESCRIPTION OF THE DRAWINGS

Various exemplary embodiments of this invention will be described in detail, with reference to the following figures, wherein:

FIGS. 1*a* and 1*b* are schematic front and side views, respectively, of a xerographic imaging module of an image forming device incorporating various features of the invention;

DETAILED DESCRIPTION OF EXEMPLARY EMBODIMENTS

Figure 2:
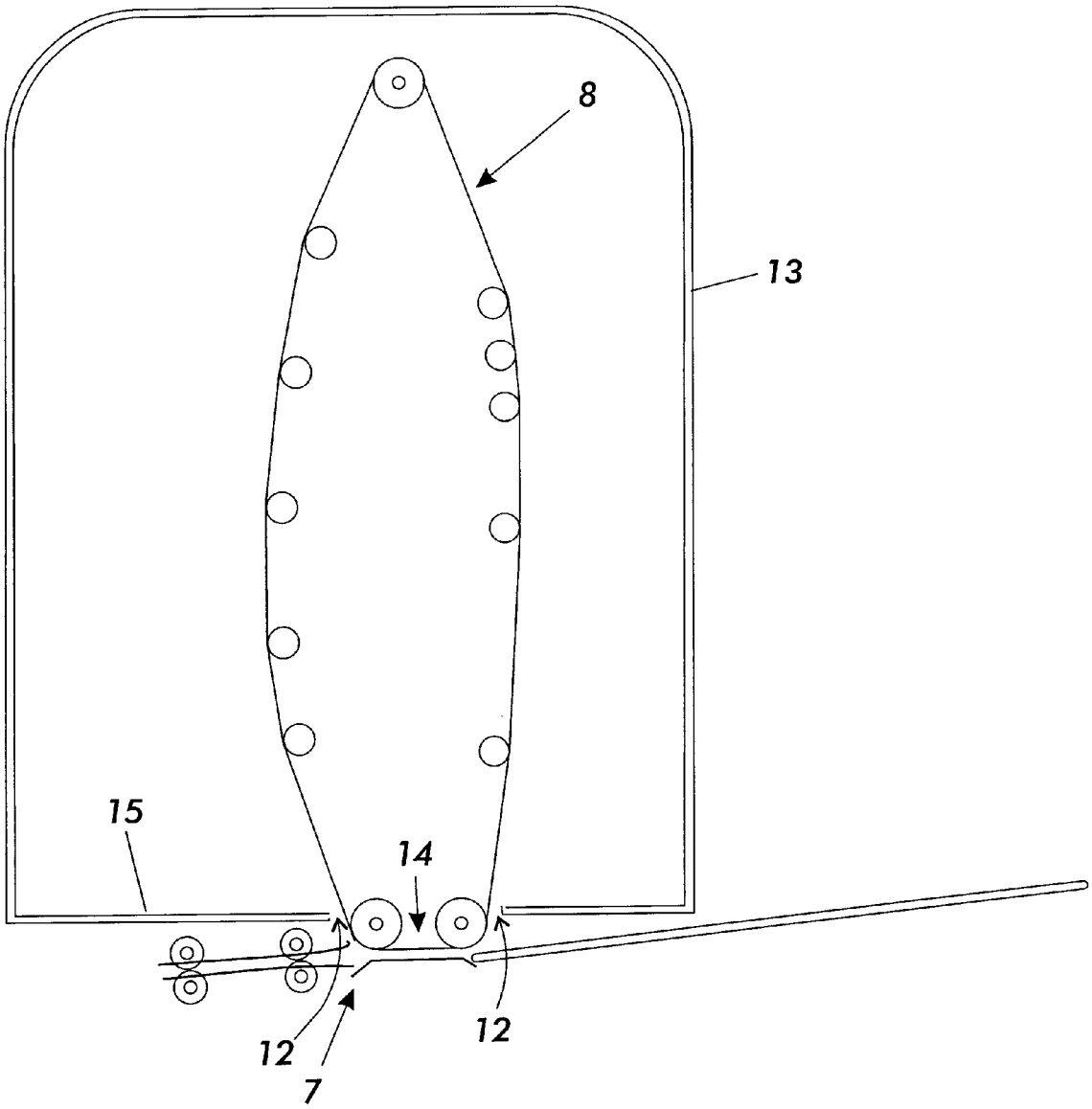
FIG. 2 is a schematic front view of a xerographic imaging module showing the general relationship of the photoreceptor and the module walls.

FIGS. 1 and 2 show one exemplary embodiment of a xerographic module 1 used in an image forming device according to this invention. FIG. 1 shows a front view of a xerographic module 1 above a media path 7. A pressurized semi-air-tight enclosure 13 is located around the xerographic module 1. A small gap 12 between the media path 7 and the enclosure 13 prevents rapid loss of pressure from the xerographic module 1. The xerographic module includes an air intake port 4 and an air exhaust port 5. The air intake and air exhaust ports 4 and 5 are connected to a remotely located air management unit. A controlled chamber intake air valve 6 is coupled to the intake air port 5. The controlled chamber intake air valve 6 is used to maintain a target air pressure inside the xerographic module 1. The xerographic module may also include a relief valve (not shown) which is opened when the image forming device is initially started to prevent drawing air into the xerographic module via the gap 12.

FIG. 2 also shows the location of the photoreceptor 8. In this instance the photoreceptor 8 is shown as a belt relative to the xerographic module 1. The photoreceptor 8 extends below the xerographic module 1 and through an opening 14 which is sized and shaped to conform closely to the size and shape of the photoreceptor 8, so that only a small gap 12 exists between the opening 14 in the bottom wall 15 of the xerographic module 1 and the photoreceptor 8. In one illustrative embodiment, the small gap 12 is on the order of 2 millimeters wide, the total area of the gap is about 10 square inches, and the pressure of the air in the xerographic module 1 is 0.25 inches of water. In the incorporated 994 application, the air pressure in the xerographic module 1 is maintained at a pressure above ambient pressure, air supplied to the xerographic module 1 is typically supplied at 225 cubic feet per minute (CFM), return air is typically supplied at 300 CFM, make-up air is typically supplied at 75 CFM and air discharged from the environmental control unit was typically discharged at 300 CFM. This results in a positive pressure differential between the air in the xerographic module 1 and the air outside the xerographic module 1. This gap prevents too rapid a loss of pressure in the xerographic module 1.

In a first illustrative embodiment of this invention, the air pressure in the xerographic module is maintained above the ambient atmospheric pressure based on measurement of ambient atmospheric pressure by an altimeter. A pressure sensor 2 is located in the xerographic module to monitor the pressure of the air of the xerographic module. A pressure sensor in the form of an altimeter 3 is provided outside of the xerographic module to monitor the ambient atmospheric pressure. A controlled chamber intake valve 6 is provided to control the pressure within the xerographic module to a set point, or a target pressure , which is determined to be above ambient atmospheric pressure outside of the xerographic module. A controller 210 is provided to monitor the pressure readings taken inside and outside of the xerographic module by the pressure sensors 2 and 3 and to determine a target range of pressures which are above the ambient pressure, and to control the controlled chamber intake valve 6 to maintain the air pressure within the xerographic module within the target range of pressures. In one exemplary embodiment, a target pressure within the xerographic module is 0.25 inch of water at standard ambient atmospheric pressure and temperature.

Figure 3:
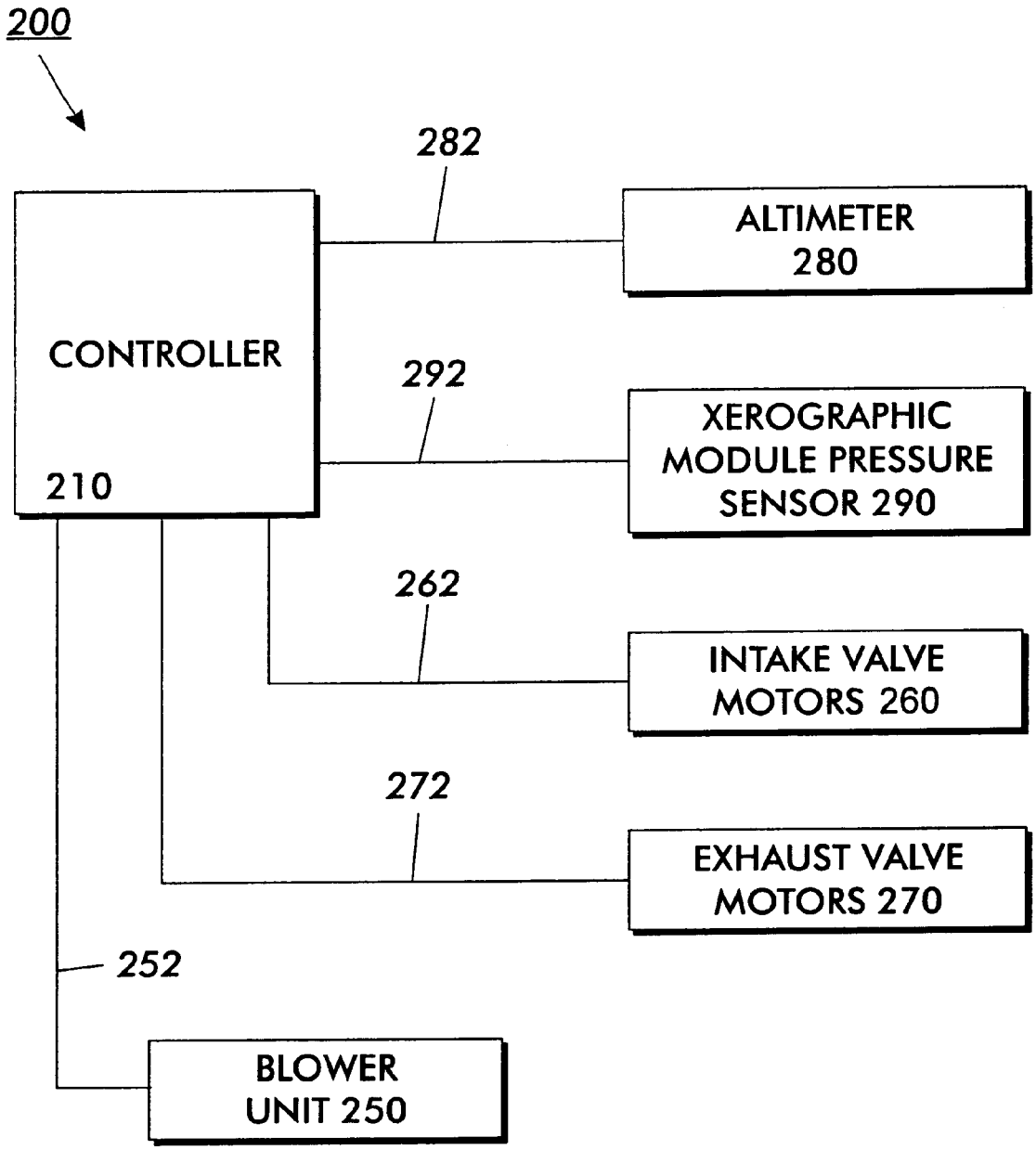
FIG. 3 is a block diagram of a control system that maintains the pressure of the xerographic module above the ambient pressure.

FIG. 3 shows one exemplary embodiment of a control system 200 usable to maintain the air pressure in the xerographic unit at a desired value. As shown in FIG. 3, the control system includes a controller 210 connected via a link 282 to an altimeter 280, a link 292 to a xerographic module pressure sensor 290, a link 262 to intake valve motors 260, a link 272 to exhaust valve motors 270 , and a link 252 to a blower unit 250. The controller 210 receives signals from the altimeter 280 and xerographic module pressure sensor 290 and processes these signals to control the air intake and exhaust valve motors 260 and 270 and blower unit 250 to maintain the pressure in the xerographic module 1 within desired ranges of air pressure. An optimum value of pressure within the xerographic module 1 is 0.25 inch of water. If the controller 210 determines that the air pressure value in the xerographic module 1 is too high or too low, the controller 210, inside remaining will adjust the amount of air furnished by the blower unit 250 and control the air intake and exhaust ports 4 and 5 to restore the air pressure to that value or to a point within a desired range of values empirically determined to limit contaminant entry into the xerographic module 1 and to remove some contaminants which form within the xerographic module 1.

Figure 4:
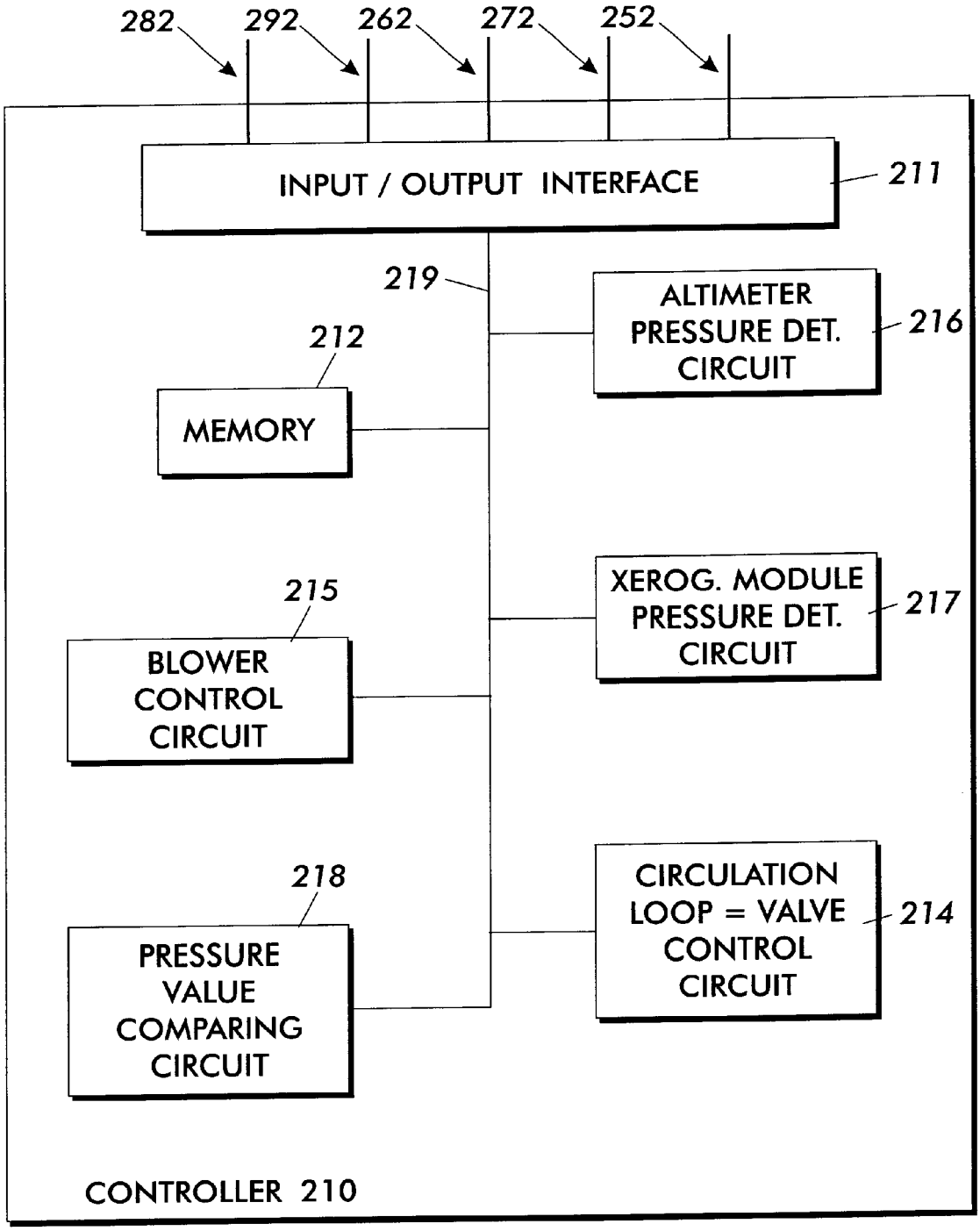
FIG. 4 is a block diagram of elements of a controller portion of the control system that maintains the pressure of the xerographic module above the ambient pressure.

FIG. 4 shows in greater detail one exemplary embodiment of the controller 210. As shown in FIG. 4, the controller 210 includes an interface 211, a memory 212, an air circulation loop and valve control circuit 214, a blower control circuit 215, an altimeter pressure determination circuit 216, a xerographic module pressure determination circuit 217, and a pressure value comparing circuit 218, interconnected by a data control bus 219. The interface 211 connects to the links 252, 262, 272, 282 and 292 and to the data/control bus 219 to transmit data and control signals to and from the control units 213–218 and/or memory 212 of the controller 210.

In operation, signals from the altimeter 280 and xerographic module pressure sensor 290 are detected by controller 210 through the interface 211. These signals are sampled by the altimeter detection and processing circuit 216 and the xerographic module pressure determination and processing circuit 217, respectively, and forwarded to a pressure value comparing circuit 218, where their difference is determined. The pressure values and their difference is stored in the memory 212. When the difference in the ambient pressure and the pressure in the xerographic module 1 is less than a predetermined value, for example, 0.25 inch of water, the controller 210 actuates the circulation loop and valve control circuit 214 and the blower control circuit 215 to increase the amount of air flowing through the system to increase the pressure difference to a value within a desired range of values. Of course, if the pressure difference exceeds a predetermined value, the controller 21 Oactuates the circulation loop and valve control circuit 214 and the blower circuit 215 to decrease the amount of air flowing through the system to lower the pressure difference to a value within a desired range of values.

The controller 210 may be implemented on a programmed general purpose computer. However, the controller 210 can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device capable of implementing a finite state machine that is in turn capable of implementing the control functions referred to above can be used to implement the controller 210. The links 252–292 can be implemented using any known or later developed device or system for connecting the controller 210 to the components 250–290. In general, the links 252–292 can be any known or later developer connection system or structure usable to connect the controller 210 to the components 250–290.

Maintaining the air pressure within the xerographic module above the ambient pressure at all times reduces the chance that contaminants, such as paper dust, water vapor, chemicals, e.g., ozone, ammonia, fuser oil, paper duct from cutting of paper, and the like, will enter the xerographic module and contaminate the components within the xerographic module.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An image forming device comprising:

a chamber pressurized at a pressure above ambient pressure; and a xerographic module contained within the pressurized chamber; wherein:

the xerographic module includes a photoreceptor, the chamber having a wall having an opening, and a portion of the photoreceptor protrudes through the opening in the chamber wall, such that a small gap is formed between the photoreceptor and the opening in the chamber wall.

2. The image forming device of claim 1, further comprising an altimeter.

3. An image forming device comprising:

a chamber pressurized at a pressure above ambient pressure; and a xerographic module contained within the pressurized chamber;

an opening in the chamber that reduces the occurrence of rapid pressure loss from the chamber.

4. An image forming device comprising:

a chamber pressurized at a pressure above ambient pressure;

a xerographic module contained within the pressurized chamber; and a control system that adjusts the pressure within the chamber relative to the ambient pressure outside of the chamber.

5. A method of maintaining air pressure within a xerographic module of an image forming device above an ambient air pressure, comprising:

measuring the air pressure in the xerographic module;

measuring the ambient air pressure outside the xerographic module;

determining a target range of air pressures within the xerographic module which are above the ambient air pressure; and maintaining the air pressure inside of the xerographic module within the target air pressure range.

6. The method of claim 5, wherein measuring the ambient air pressure comprises measuring the ambient air pressure using an altimeter.

* * * * *